United States Patent [19]

Leonetti et al.

[11] Patent Number: 4,693,496

[45] **Date of Patent: * Sep. 15, 1987**

[54] ELASTOMERIC COATING REMOVAL PROCESS

[76] Inventors: Fred L. Leonetti; Richard L. Leonetti; Frank A. Leonetti, all of P.O. Box 6622, Concord, Calif. 94524

[ * ] Notice: The portion of the term of this patent subsequent to Dec. 9, 2003 has been disclaimed.

[21] Appl. No.: 894,169

[22] Filed: Aug. 7, 1986

Related U.S. Application Data

[63] Continuation of Ser. No. 843,870, Mar. 25, 1986, Pat. No. 4,627,643, which is a continuation-in-part of Ser. No. 803,002, Nov. 29, 1985, abandoned.

[51] Int. Cl.[4] ..... B42D 15/00

[52] U.S. Cl. ..... 283/102; 51/181 NT; 283/903

[58] Field of Search ..... 51/181 R, 18 NT, 407, 51/281 R, 205 R, 310, 311, 312, 328; 273/139; 283/100, 101, 102, 903

[56] References Cited

U.S. PATENT DOCUMENTS

| | | | |
|---|---|---|---|
| 1,363,546 | 12/1920 | Aiken | 51/181 |
| 3,773,328 | 11/1973 | Seidman | 273/139 |
| 3,829,133 | 8/1974 | Romanoff | 283/102 |
| 3,900,219 | 8/1975 | D'Amato et al. | 283/903 X |
| 4,095,824 | 6/1978 | Bachman | 283/904 X |
| 4,241,942 | 12/1980 | Bachman | 283/904 X |
| 4,398,708 | 8/1983 | Goldman et al. | 270/18 |
| 4,466,614 | 8/1984 | Bachman et al. | 273/139 |
| 4,491,319 | 1/1985 | Nelson | 273/1 R |

FOREIGN PATENT DOCUMENTS

| | | | |
|---|---|---|---|
| 326480 | 6/1915 | France | 51/181 |
| 8100699 | 9/1982 | Netherlands . | |
| 598964 | 5/1978 | Switzerland . | |
| 1580768 | 12/1980 | United Kingdom . | |

*Primary Examiner*—Paul A. Bell

*Attorney, Agent, or Firm*—Townsend and Townsend

[57] ABSTRACT

A process and procedure for removing elastomeric and other coatings, that are used to conceal indicia on contest cards, chance tickets, game cards, lottery tickets, etc. This process consists of placing any abraded edge or spot on a portion of the contest card or ticket so that said card or ticket may be folded over or used independently to remove coating that conceals indicia. The abraded edge or spot may also retain coating on card or ticket.

4 Claims, 12 Drawing Figures

ELASTOMERIC COATING REMOVAL PROCESS

This is a continuation of application Ser. No. 843,870 filed Mar. 25, 1986, now U.S. Pat. No. 4,627,643, which is a continuation-in-part of Ser. No. 803,002 filed 11-29-85, now abandoned.

BACKGROUND OF THE INVENTION

1. Field of the Invention

This invention relates to contest cards; a process for removing their concealing coatings.

2. Description of the Prior Art

Contest cards with indicia concealing coatings need a separate device, coin or fingernail to remove such coatings. When such coatings are scraped off by a coin or fingernail, the material forming the coatings is dispersed into the environment, frequently landing on floors or tables or under fingernails. Material from such coatings are of a sticking nature and are difficult to remove.

SUMMARY OF THE INVENTION

The object of the invention, therefore, is to provide an abrading method of removing these coatings from contest cards and retaining the coating on the contest card. The invention resides in an adhesive strip or spot on a portion of the contest card, formed by applying sand or any form of grit or by pitting the card such as, for example, by impressing it with a file-surfaced type of tool to form a pitted pattern consisting of a series of lines, a cross-hatched pattern, dots or the like. The effect is to make one portion of the contest card abraded.

DETAILED DESCRIPTION OF DRAWINGS

Figure 1:
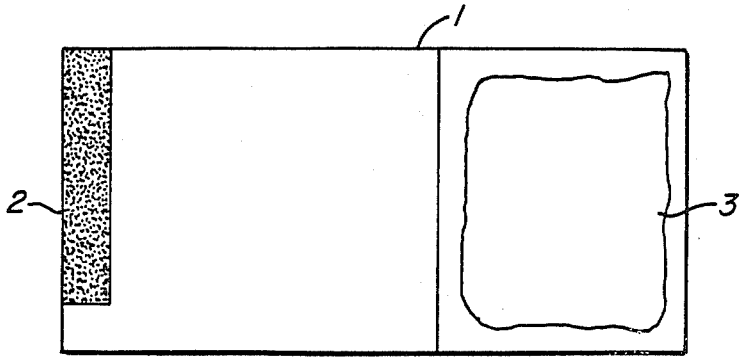
FIG. 1 is a top view of a contest card with an abrading region in accordance with the present invention.

FIG. 1 shows contest card reference numeral 1, abraded area reference numeral 2, and contest card coating reference Numeral 3.

Figure 2:
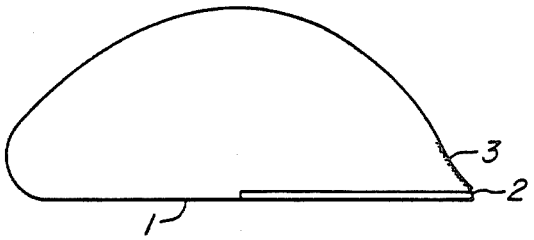
FIG. 2 shows contest card from side view, being folded from left to right with abraded edge placed on coating.

FIG. 2 shows contest card reference numeral 1. It also shows left side of contest card with abraded area reference Numeral 2 being folded over from left to right and being placed on contest card coating reference Numeral 3.

Figure 3:
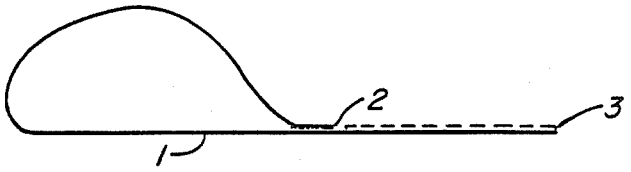
FIG. 3 shows contest card abraded edge being rubbed over coating from right to left thus removing said coating and attaching it to abraded edge.
Figure 4:
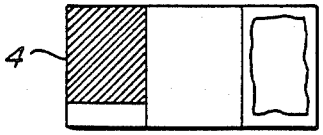
FIGS. 4, 5, 6, 7 and 8 show some possible designs and material applications for the abraded area of the contest card.
Figure 5:
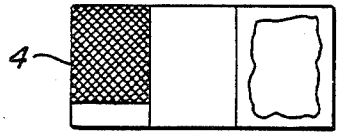
Figure 6:
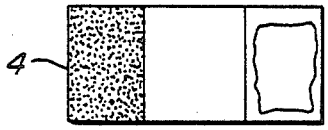
Figure 7:
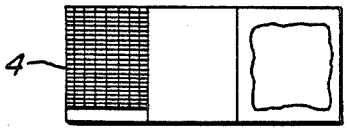

FIG. 3 shows contest card reference numeral 1 after left side of card with abraded area reference numeral 2 has been rubbed across portion of contest card that contains coating reference numeral 3. With a combination of friction which creates heat, the coating fuses together is removed and is deposited on abraded area reference numeral 2.

FIGS. 4, 5, 6, 7 shows types of designs for abraded area that would be impressioned by a file surfaced type of tool into the contest card thus creating an abrading surface. Abraded surface appears on left sides, reference numeral 4.

Figure 8:
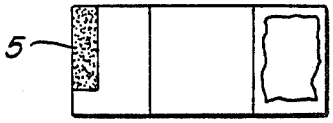

FIG. 8 shows abrading edge reference numeral 5. But instead of impressioned like reference numerals 4,5,6, and 7, the abraded edge is made out of sand or any type of grit secured by an adhesive, the same method of coating removal as shown in FIGS. 1, 2 and 3, is used by both impressioning abraded edge into contest card and by applying sand or grit to one portion of contest card as to make it abraded.

Figure 9:
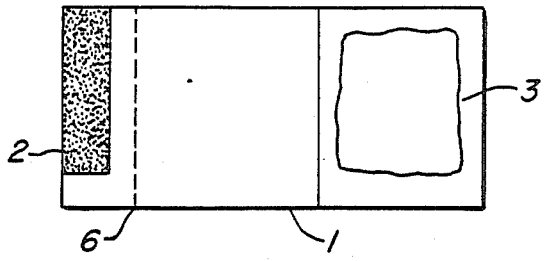
FIGS. 9, 10, 11 and 12 show how the abraded portion of the contest card may be used independently to remove the coating from said card and to attach said coating to said abraded portion.

FIG. 9 shows the contest card from a front view illustrating card 1, abraded area 2, perforation/detachment line 6, and contest card coating 3.

Figure 10:
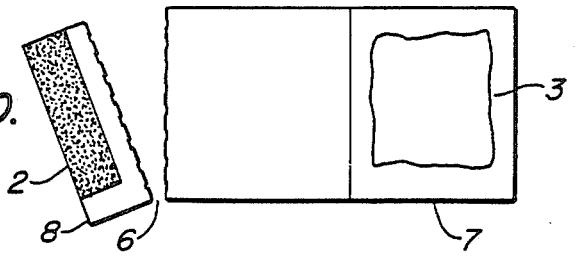

FIG. 10 shows a contest card front view. In this view the card right side 7, containing contest card coating 3, is separated from the card left side 8, which side contains abraded area 2. The separation is achieved by tearing the contest card right and left sides apart at the contest card perforation/detachment line 6.

Figure 11:
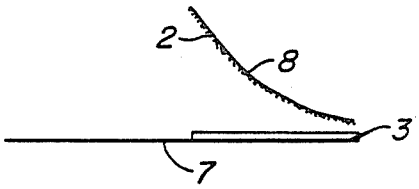

FIG. 11 is a side view of the contest card showing separated left side 8 which contains the abraded area 2 placed on the contest card coating 3 with said coating being on the separated card right side 7.

Figure 12:
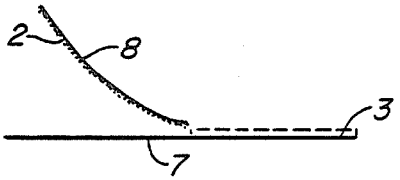

FIG. 12 shows the contest card from a side view, after the separated left side 8 with abraded area 2 has been rubbed from right to left across separated right side 7 thus removing contest card coating 3 and depositing and fusing said coating onto the abraded area 2 by a combination of friction and heat produced by said rubbing.

What is claimed is:

1. In a card whose surface contains printed information concealed by a removable opaque coating, the improvement comprising a pitted region on said card for abrading said removable opaque coating to expose said printed information, and a perforated line separating said pitted region from the remainder of said card to facilitate detachment thereof.

2. A card in accordance with claim 1 in which said pitted region is comprised of an array of indentations for retaining material from said removable opaque coating upon separation thereof from said card.

3. In a flexible card whose surface contains printed information concealed by a removable opaque coating, the improvement comprising a pitted region on said card for abrading said removable opaque coating to expose said printed information when said card is folded, bringing said embossed region into contact with said removable opaque coating.

4. A flexible card in accordance with claim 3 in which said pitted region is comprised of an array of indentations for retaining material from said removable opaque coating upon separation thereof from said card.

* * * * *